US011001931B2

(12) United States Patent
DeYoung et al.

(10) Patent No.: US 11,001,931 B2
(45) Date of Patent: May 11, 2021

(54) SYSTEMS AND METHODS FOR PURIFYING ALUMINUM

(71) Applicant: ALCOA USA CORP., Pittsburgh, PA (US)

(72) Inventors: David H. DeYoung, Export, PA (US); Xinghua Liu, Murrysville, PA (US); Brent L. Mydland, Gibsonia, PA (US); James Wiswall, Pittsburgh, PA (US)

(73) Assignee: ALCOA USA CORP., Pittsburgh, PA (US)

( * ) Notice: Subject to any disclaimer, the term of this patent is extended or adjusted under 35 U.S.C. 154(b) by 0 days.

(21) Appl. No.: 16/547,454

(22) Filed: Aug. 21, 2019

(65) Prior Publication Data

US 2019/0376197 A1 Dec. 12, 2019

Related U.S. Application Data

(63) Continuation of application No. 15/041,899, filed on Feb. 11, 2016, now Pat. No. 10,407,786.

(60) Provisional application No. 62/114,961, filed on Feb. 11, 2015.

(51) Int. Cl.

| | |
|---|---|
| ***C25C 3/24*** | (2006.01) |
| ***C25C 3/18*** | (2006.01) |
| ***C25C 3/12*** | (2006.01) |
| ***C25C 3/14*** | (2006.01) |
| ***C25C 7/00*** | (2006.01) |
| ***C25C 7/02*** | (2006.01) |
| ***B22D 21/00*** | (2006.01) |
| ***C25C 3/08*** | (2006.01) |

(52) U.S. Cl.

CPC ..... *C25C 3/24* (2013.01); *B22D 21/007* (2013.01); *C25C 3/08* (2013.01); *C25C 3/12* (2013.01); *C25C 3/125* (2013.01); *C25C 3/14* (2013.01); *C25C 3/18* (2013.01); *C25C 7/005* (2013.01); *C25C 7/025* (2013.01)

(58) Field of Classification Search

CPC ..... C25C 3/06–24; C25C 7/005

See application file for complete search history.

(56) References Cited

U.S. PATENT DOCUMENTS

| | | | | |
|---|---|---|---|---|
| 3,386,908 A * | 6/1968 | Daurat | C25C 7/005 204/247.4 |
| 4,222,830 A * | 9/1980 | Dawless | C22B 21/06 205/382 |
| 5,006,209 A * | 4/1991 | Beck | C25C 3/06 204/233 |
| 6,419,813 B1 * | 7/2002 | Brown | C25C 3/16 205/374 |

(Continued)

*Primary Examiner* — Nicholas A Smith

(74) *Attorney, Agent, or Firm* — Greenberg Traurig, LLP

(57) ABSTRACT

The application is directed towards methods for purifying an aluminum feedstock material. A method provides: (a) feeding an aluminum feedstock into a cell (b) directing an electric current into an anode through an electrolyte and into a cathode, wherein the anode comprises an elongate vertical anode, and wherein the cathode comprises an elongate vertical cathode, wherein the anode and cathode are configured to extend into the electrolyte zone, such that within the electrolyte zone the anode and cathode are configured with an anode-cathode overlap and an anode-cathode distance; and producing some purified aluminum product from the aluminum feedstock.

6 Claims, 5 Drawing Sheets

(56) References Cited

U.S. PATENT DOCUMENTS

2004/0112757 A1* 6/2004 Siljan ..... C25C 3/08
205/372

* cited by examiner

SYSTEMS AND METHODS FOR PURIFYING ALUMINUM

CROSS-REFERENCE TO RELATED APPLICATIONS

This application is a continuation of U.S. patent application Ser. No. 15/041,899, filed Feb. 11, 2016, which claims the benefit of U.S. Patent Application No. 62/114,961, filed Feb. 11, 2015, each of which is incorporated herein by reference in its entirety

BACKGROUND

The Hoopes process is an electrolytic process that has been used to obtain aluminum metal of very high purity.

FIELD OF THE INVENTION

Generally, the application is directed towards different configurations and processes of utilizing electrolysis cells in order to provide a purified aluminum product from a feedstock containing aluminum metal. More specifically, the application is directed towards utilizing vertically oriented, interspaced anode and cathode configuration, where the anodes and cathodes are configured from aluminum-wettable material, in order to reduce inter-polar distance, and increase the electrode surface area (e.g. purification zone) of an electrolysis cell operating to produce purified aluminum metal product from an aluminum feedstock with much lower energy consumption and higher productivity (e.g. feedstock including an aluminum metal and/or alloys thereof).

SUMMARY OF THE INVENTION

In one aspect, a method is provided, comprising: (a) feeding an aluminum feedstock into a cell access channel of an aluminum electrolysis cell, wherein the aluminum electrolysis cell is configured with at least two zones, including a molten metal pad zone and an electrolyte zone (e.g. reaction/purification zone), further wherein the aluminum feedstock is retained in the molten metal pad zone; (b) directing an electric current into an anode through an electrolyte and into a cathode, wherein the anode comprises an elongate vertical anode, and wherein the cathode comprises an elongate vertical cathode, wherein the anode and cathode are configured to extend into the electrolyte zone (e.g. in an opposing, interspaced configuration) such within the electrolyte zone the anode and cathode are configured with an anode-cathode overlap and an anode-cathode distance [wherein the anode, cathode, and electrolyte are configured (electrically and mechanically) to be contained within an aluminum electrolysis cell]; (c) wetting at least a portion of the surface of the elongate vertical anode with a molten material from the molten metal pad layer, wherein the molten material includes aluminum metal; (d) concomitant with the directing step, producing at least some aluminum ions in the electrolyte from the aluminum metal on the surface of the elongate vertical anode; and (e) concomitant with the directing step, reducing at least some of the aluminum ions in the bath onto the surface of the elongate vertical cathode to produce a molten purified aluminum product.

In some embodiments, the method includes: prior to the feeding step, melting the feedstock material.

In some embodiments, the method includes: collecting at least some of the purified aluminum product top layer, wherein the top layer comprises a molten purified aluminum product.

In some embodiments, the method includes: removing a purified aluminum product from the aluminum electrolysis cell.

In some embodiments, the removing step comprises tapping the cell.

In some embodiments, the removing step comprises: casting the purified aluminum product into an ingot to provide an aluminum product having an aluminum purity of at least 99.5 wt. %.

In some embodiments, the method includes: collecting at least some of the purified aluminum top layer, wherein the top layer comprises a purified aluminum product.

In some embodiments, the method includes: removing sludge and/or raffinate from the molten metal pad in the aluminum electrolysis cell via the cell access channel.

In some embodiments, the anodes and cathodes are configured from an aluminum-wettable material.

In some embodiments, the directing step further comprises supplying an electric current to the elongate vertical anode.

In some embodiments, the anode and cathode are submerged in the electrolyte.

In some embodiments, the method includes: the purified aluminum product comprises an aluminum purity of at least 99.5 wt. % up to 99.999 wt. % Al.

In some embodiments, the method includes: the purified aluminum product comprises an aluminum purity at least 99.8 wt. % up to 99.999 wt. % Al.

In some embodiments, the purified aluminum product comprises an aluminum purity of at least 99.9 wt. % up to 99.999 wt. % Al.

In some embodiments, the method includes: the purified aluminum product comprises an aluminum purity of at least 99.98 wt. % up to 99.999 wt. % Al.

In another aspect, a method is provided, comprising: (a) providing an aluminum electrolysis cell including at least two zones, including a molten metal pad zone including an aluminum feedstock (e.g. feedstock zone) and an electrolyte zone (e.g. reaction/purification zone); (b) directing an electric current into an anode through an electrolyte and into a cathode, wherein the anode comprises an elongate vertical anode, and wherein the cathode comprises an elongate vertical cathode, wherein the anode and cathode are in electrical communication with the electrolyte and are configured to extend into the electrolyte zone (e.g. in an opposing, interspaced configuration) such that the anode and cathode are configured with an anode-cathode overlap and an anode-cathode distance; wherein the anode, cathode, and electrolyte are configured to be contained within an aluminum electrolysis cell; (c) wetting at least a portion of the surface of the elongate vertical anode with a molten material from the molten metal pad zone, wherein the molten material includes aluminum metal; (d) concomitant with the directing step, producing at least some aluminum ions in the electrolyte from the aluminum metal on a surface of the elongate vertical anode; and (e) concomitant with the directing step, reducing at least some of the aluminum ions in the bath onto a surface of the elongate vertical cathode to produce a molten purified aluminum product.

In some embodiments, the method includes: forming a third zone including a purified aluminum product, wherein the third zone is configured above the electrolyte zone to define a top layer.

In some embodiments, the method includes: removing at least a portion of the purified aluminum product from the aluminum electrolysis cell via a tapping operation.

In some embodiments, the method includes: casting the purified aluminum product into a cast form (e.g. ingot).

In some embodiments, the method includes: (a) feeding an aluminum feedstock into a cell access channel of an aluminum electrolysis cell.

In some embodiments, the method includes purifying aluminum such that the purified aluminum product is produced via the electrolysis cell at an energy efficiency of 1 to 15 kWh/kg of purified aluminum product.

In some embodiments, the purified aluminum is produced via the electrolysis cell at an energy efficiency of 2 to 10 kWh/kg of purified aluminum product.

In some embodiments, the purified aluminum product is produced via the electrolysis cell at an energy efficiency of 2 to 6 kWh/kg of purified aluminum.

In some embodiments, the method includes: purging the cell chamber with an inert gas.

In some embodiments, the method includes: flowing an inert gas into the aluminum electrolysis cell via an inert gas inlet configured within a refractory top cover of the aluminum electrolysis cell, wherein the inert gas is configured to provide an inert atmosphere within the vapor space defined in the cell chamber (e.g. positioned above the electrolyte and/or purified aluminum product).

In some embodiments, the method includes: adding densifying aids into the aluminum feedstock in order to configure the density of the aluminum feedstock for retention in the molten metal pad zone prior to the wetting step.

In some embodiments, the method includes: adding bath components to the aluminum electrolysis cell via the cell access channel.

In some embodiments, the bath components are configured to supplement the electrolyte and promote the producing and reducing steps.

In some embodiments, the elongate vertical anode comprises at least one of TiB2, ZrB2, HfB2, SrB2, carbonaceous material, W, Mo, steel and combinations thereof and the elongate vertical cathode comprises at least one of TiB2, ZrB2, HfB2, SrB2, carbonaceous material, and combinations thereof.

In another aspect, an aluminum electrolysis cell is provided, comprising: (a) a base, refractory sidewalls, and a refractory top cover; (b) a bottom located proximal the base, the bottom having an upper surface; (c) an anode connector in electrical communication with the bottom, the anode connector having an outer end configured to connect to an external power source; (d) an elongate vertical anode extending upward from the upper surface of the bottom, the elongate vertical anode having: (i) a proximal end connected to the upper surface of the bottom; (ii) a distal free end extending upward toward the refractory top cover; and (iii) a middle portion; (e) a cathode connector proximal the refractory top cover, the cathode connector having: (i) an upper connection rod configured to connect to the external power source; and (ii) a lower surface; (f) an elongate vertical cathode extending downward from the lower surface of the cathode connector, the elongate vertical cathode having: (i) a proximal end connected to the upper surface of the cathode connector; (ii) a distal free end extending downward toward the base; and (iii) a middle portion; wherein the elongate vertical cathode overlaps the elongate vertical anode such that the distal end of the elongate vertical cathode is proximal the middle portion of the elongate vertical anode, and the distal end of the elongate vertical anode is proximal the middle portion of the elongate vertical cathode.

In some embodiments, the cell includes: a cell chamber defined by the refractory sidewalls, the refractory top cover, and the bottom; a cell access channel penetrating a lower portion of a refractory sidewall thereby providing access to a lower portion of the cell chamber, the cell access channel having an access port.

In some embodiments, the cell includes: an aluminum extraction port penetrating an upper portion of a refractory sidewall, thereby providing access to an upper portion of the cell chamber.

In some embodiments, the cell includes: an inert gas inlet formed in the refractory top cover configured to provide an inert atmosphere to the cell chamber.

In some embodiments, the cell includes: an outer shell, wherein the outer shell comprises: a shell floor located beneath the base; and shell sidewalls spaced apart from and surrounding the refractory sidewalls.

In some embodiments, the cell includes: thermal insulation, wherein the thermal insulation is located between the shell floor and the base, and between the shell sidewalls and the refractory sidewalls.

In some embodiments, the elongate vertical anodes are aluminum-wettable.

In some embodiments, the anode is selected from the group consisting of: at least one of TiB2, ZrB2, HfB2, SrB2, carbonaceous material, W, Mo, steel and combinations thereof.

In some embodiments, the elongate vertical cathode is aluminum-wettable.

In some embodiments, the cathode is selected from the group consisting of: at least one of TiB2, ZrB2, HfB2, SrB2, carbonaceous material, and combinations thereof.

In another aspect, a method is provided, comprising: (a) supplying an electric current to an elongate vertical anode in an aluminum electrolysis cell, the aluminum electrolysis cell comprising: (i) a base, refractory sidewalls, and a refractory top cover; (ii) a bottom located proximal the base; (iii) a cell chamber defined by the refractory sidewalls, the refractory top cover, and the bottom; (iv) a molten metal pad contained in the cell chamber above the bottom; wherein the molten metal pad comprises aluminum and impurities; (v) a top layer of purified aluminum contained in the cell chamber above the molten metal pad; (vi) an electrolyte contained in the cell chamber and separating the top layer from the bottom layer of molten metal pad; (vii) the elongate vertical anode extending upward from the bottom, through the molten metal pad and terminating in the electrolyte; (viii) a cathode connector proximal the refractory top cover (ix) an elongate vertical cathode extending downward from the cathode connector and terminating in the electrolyte such that the elongate vertical cathode overlaps the elongate vertical anode within the electrolyte; (b) wetting at least a portion of the surface of the elongate vertical anode with molten material from the molten metal pad; (c) producing aluminum ions from the molten metal pad via the elongate vertical anode; (d) reducing at least some of the aluminum ions via the elongate vertical cathode, thereby producing purified aluminum; (e) collecting at least some of the purified aluminum in the top layer.

In some embodiments, the method includes providing purified aluminum having at least 99.5 wt. % up to 99.999 wt. % Al.

In some embodiments, the method includes providing purified aluminum having at least 99.8 wt. % up to 99.999 wt. % Al.

In some embodiments, the method includes providing purified aluminum having at least 99.9 wt. % up to 99.999 wt. % Al.

In some embodiments, the method includes providing purified aluminum having at least 99.98 wt. % to 99.999 wt. % Al.

In some embodiments, the method includes adding aluminum feedstock into the cell chamber via a cell access port.

In some embodiments, the adding step comprises metering aluminum feedstock into the cell chamber at a first feed rate.

In some embodiments, the method includes removing purified aluminum from the cell chamber at a second removal rate.

In some embodiments, the first feed rate is controlled based at least in part on the second removal rate.

In some embodiments, the adding step comprises periodically adding the aluminum feedstock into the cell chamber.

In some embodiments, the method includes periodically removing purified aluminum from the cell chamber.

In some embodiments, the method includes producing purified aluminum such that the purified aluminum is produced via the electrolysis cell at an energy efficiency of 1 to 15 kWh/kg of purified aluminum.

In some embodiments, the method provides that the purified aluminum is produced via the electrolysis cell at an energy efficiency of 2 to 10 kWh/kg of purified aluminum.

In some embodiments, the method provides that the purified aluminum is produced via the electrolysis cell at an energy efficiency of 2 to 6 kWh/kg of purified aluminum.

In some embodiments, the method includes purging the cell chamber with an inert gas.

DETAILED DESCRIPTION

Figure 1:
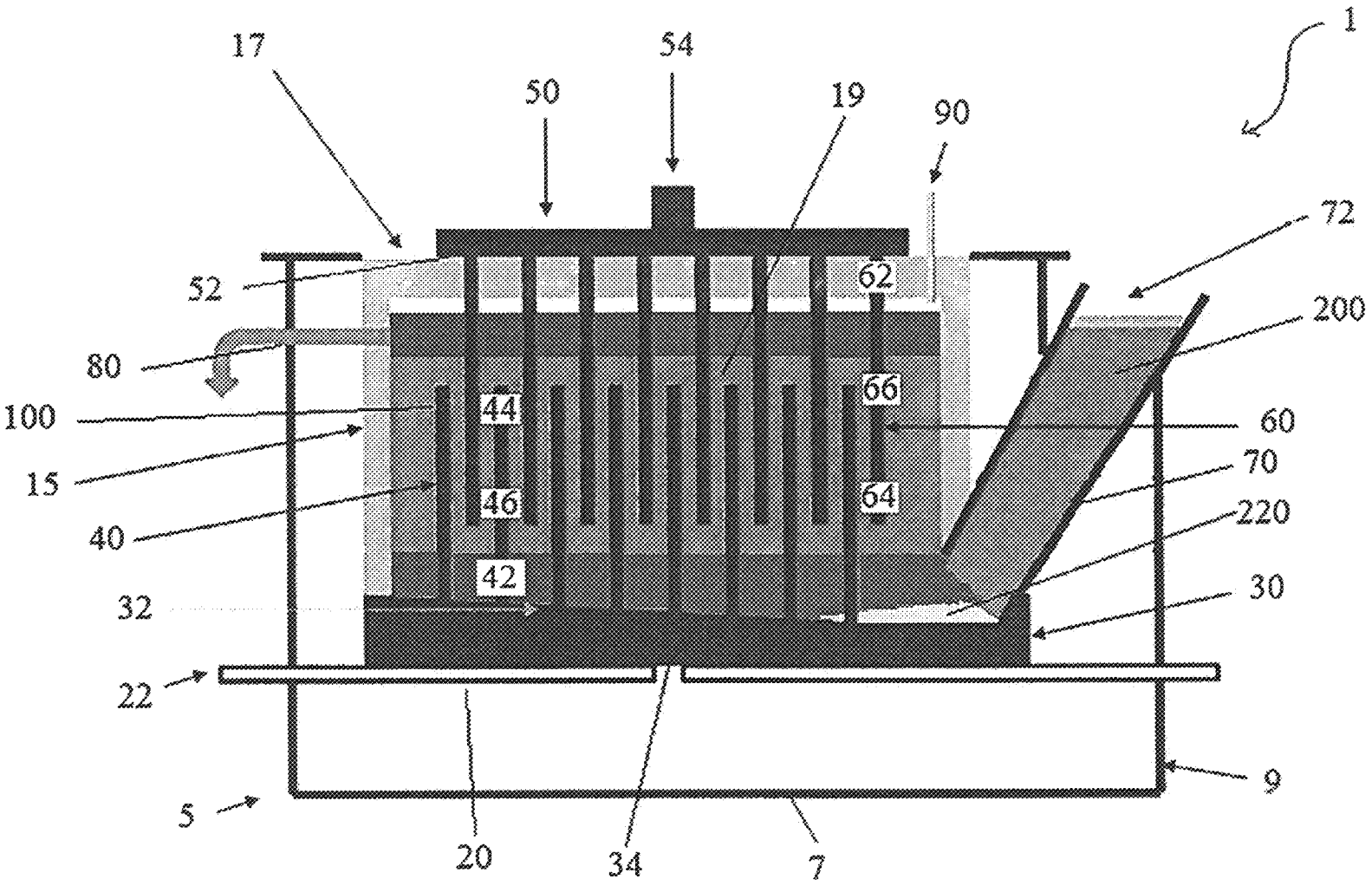
FIG. 1 is a schematic cut-away side view of an embodiment of an electrolysis cell for purifying aluminum in accordance with the instant disclosure.

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

As used herein, "aluminum feedstock" means material having at least 80 wt. % aluminum.

As used herein, "purified molten aluminum" means molten material having at least 99.5 wt. % aluminum.

As used herein, "molten metal pad" means a reservoir of molten material located below an electrolyte, wherein the molten material comprises aluminum.

As used herein, "sludge" means waste material precipitated during aluminum purification. In some embodiments, sludge comprises solid material.

As used herein, "raffinate" means aluminum containing a very high impurity content.

As used herein, "aluminum-wettable" means having a contact angle with molten aluminum of not greater than 90 degrees.

As used herein, "electrolyte" means a medium in which the flow of electrical current is carried out by the movement of ions/ionic species. In one embodiment, an electrolyte may comprise molten salt.

As used herein, "energy efficiency" means the amount of energy (in kilowatt hours) consumed by an aluminum electrolysis cell per kilogram of purified aluminum produced by the aluminum electrolysis cell. Thus, energy efficiency may be expressed in kilowatt hours/kilogram of aluminum produced (kWh/kg).

As used herein, "anode-cathode overlap" (ACO) means the vertical distance from the distal end of an elongate vertical anode to the distal end of a respective elongate vertical cathode.

As used herein, "anode to cathode distance" (ACD) means the horizontal distance separating an elongate vertical anode from a respective elongate vertical cathode.

In one embodiment, the present invention comprises an aluminum electrolysis cell. The cell may include a base, refractory sidewalls, and a refractory top cover. The cell may include a bottom located proximal the base, wherein the bottom has an upper surface. The cell may include an anode connector in electrical communication with the bottom, the anode connector having an outer end configured to connect to an external power source. The cell may include an elongate vertical anode extending upward from the upper surface of the bottom. The elongate vertical anode may have a proximal end connected to the upper surface of the bottom, a distal free end extending upward toward the refractory top cover, and a middle portion. The cell may include a cathode connector proximal the refractory top cover. The cathode connector may have an upper connection rod configured to connect to the external power source, and a lower surface. The cell may have an elongate vertical cathode extending downward from the lower surface of the cathode connector. The elongate vertical cathode may have a proximal end connected to the upper surface of the cathode connector, a distal free end extending downward toward the base, and a middle portion. In one embodiment, the elongate vertical cathode overlaps the elongate vertical anode such that the distal end of the elongate vertical cathode is proximal the middle portion of the elongate vertical anode, and the distal end of the elongate vertical anode is proximal the middle portion of the elongate vertical cathode.

In one embodiment, the aluminum electrolysis cell includes a cell chamber defined by the refractory sidewalls, the refractory top cover, and the bottom. The cell may include an access channel penetrating a lower portion of a refractory sidewall, thereby providing access to a lower portion of the cell chamber. The cell access channel may have an access port.

In one embodiment, the aluminum electrolysis cell includes an aluminum extraction port penetrating an upper portion of a refractory sidewall, thereby providing access to an upper portion of the cell chamber. In one embodiment, the aluminum electrolysis cell includes an inert gas inlet formed in the refractory top cover configured to provide an inert atmosphere to the cell chamber.

In one embodiment, the aluminum electrolysis cell includes an outer shell, wherein the outer shell comprises: a shell floor located beneath the base; and shell sidewalls spaced apart from and surrounding the refractory sidewalls. The aluminum electrolysis cell may include thermal insulation, wherein the thermal insulation is located between the shell floor and the base, and between the shell sidewalls and the refractory sidewalls.

In one embodiment, the elongate vertical anode is aluminum-wettable. In this regard, the elongate vertical anode may include at least one of TiB2, ZrB2, HfB2, SrB2, carbonaceous material, W, Mo, steel and combinations thereof.

In one embodiment, the elongate vertical cathode is aluminum-wettable. In this regard, the elongate vertical cathode may include at least one of TiB2, ZrB2, HfB2, SrB2, carbonaceous material, and combinations thereof.

Without being bound by any particular mechanism or theory, it is believed that the anode is configured to undergo an electrochemical reaction, such that the aluminum metal with impurities is anodized to aluminum ions $Al^{3+}$ (transported to the electrolyte) such that impurities are left behind on the anode. Then, the ions are reduced onto the cathode surface and form aluminum metal, where the metal is in purified form, since the impurities remained on the anode surface and/or were collected in the metal pad (e.g. given density of the impurities vs. the electrolyte/bath components).

In one embodiment, the present invention comprises a method. The method may include supplying an electric current to an elongate vertical anode in an aluminum electrolysis cell. The aluminum electrolysis cell may include a base, refractory sidewalls, and a refractory top cover. The aluminum electrolysis cell may include a bottom located proximal the base. The aluminum electrolysis cell may include a cell chamber defined by the refractory sidewalls, the refractory top cover, and the bottom. The aluminum electrolysis cell may include a molten metal pad contained in the cell chamber above the bottom. The molten metal pad may include aluminum and impurities. The aluminum electrolysis cell may include a top layer of purified aluminum contained in the cell chamber above the molten metal pad. The aluminum electrolysis cell may include an electrolyte contained in the cell chamber and separating the top layer from the molten metal pad. The elongate vertical anode may extend upward from the bottom, through the molten metal pad and terminate in the electrolyte. The aluminum electrolysis cell may include a cathode connector proximal the refractory top cover. The aluminum electrolysis cell may include an elongate vertical cathode extending downward from the cathode connector and terminating in the electrolyte such that the elongate vertical cathode overlaps the elongate vertical anode within the electrolyte. The method may include wetting at least a portion of the surface of the elongate vertical anode with molten material from the molten metal pad. The method may include producing aluminum ions from the molten metal pad via the elongate vertical anode. The method may include reducing at least some of the aluminum ions via the elongate vertical cathode, thereby producing purified aluminum. The method may include collecting at least some of the purified aluminum in the top layer.

In some embodiments of the method, the purified aluminum comprises 99.5 wt. % to 99.999 wt. % Al. In some embodiments of the method, the purified aluminum comprises at least 99.8 wt. % to 99.999 wt. % Al. In some embodiments of the method, the purified aluminum comprises at least 99.9 wt. % to 99.999 wt. % Al. In some embodiments of the method, the purified aluminum comprises at least 99.98 wt. % to 99.999 wt. % Al.

In some embodiments, the method includes adding aluminum feedstock into the cell chamber via a cell access port. In some embodiments of the method, the adding step comprises metering aluminum feedstock into the cell chamber at a first feed rate. In some embodiments, the method includes removing purified aluminum from the cell chamber at a second removal rate. In some embodiments of the method, the first feed rate is controlled based at least in part on the second removal rate. In some embodiments of the method, the adding step includes periodically adding the aluminum feedstock into the cell chamber. In some embodiments, the method includes periodically removing purified aluminum from the cell chamber.

In some embodiments of the method, the purified aluminum is produced via the electrolysis cell at an energy efficiency of 1 to 15 kWh/kg of purified aluminum. In some embodiments of the method, the purified aluminum is produced via the electrolysis cell at an energy efficiency of 2 to 10 kWh/kg of purified aluminum. In some embodiments of the method, the purified aluminum is produced via the electrolysis cell at an energy efficiency of 2 to 6 kWh/kg of purified aluminum.

In some embodiments, the method includes purging the cell chamber (19) with an inert gas.

Figure 2:
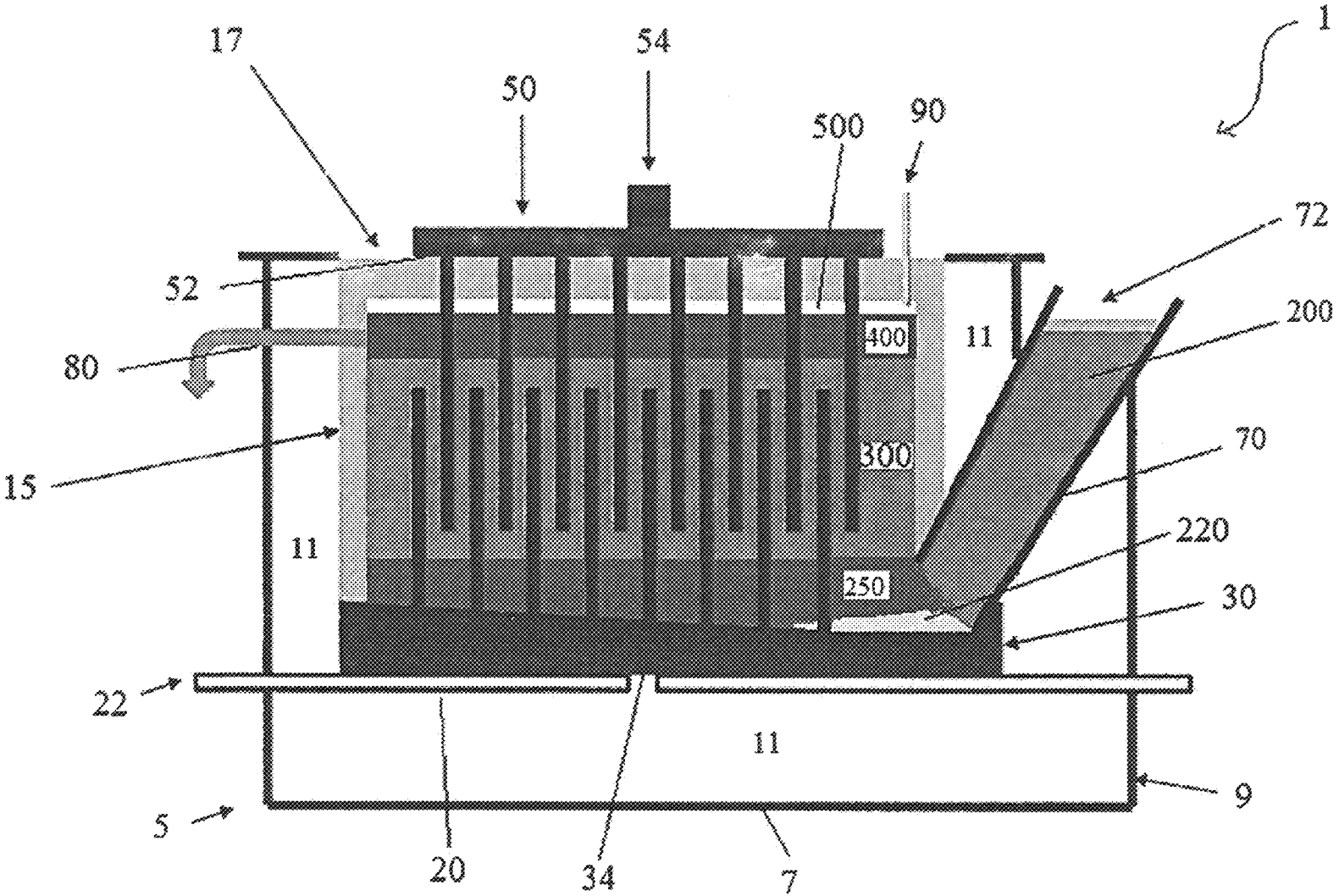
FIG. 2 is a schematic cut-away side view of an embodiment of an electrolysis cell for purifying aluminum in accordance with the instant disclosure.

FIGS. 1 and 2 are schematics of an electrolysis cell for purifying aluminum. In the illustrated embodiment, the electrolysis cell (1) comprises a base (7), refractory sidewalls (15), and a refractory top cover (17). The aluminum electrolysis cell (1) includes a bottom (30) located proximal the base (7). The bottom (30) has an upper surface (32) and a lower surface (34). In some embodiments, the upper surface (32) of the bottom (30) is sloped. In some embodiments, the slope comprises an angle of less than 10 degrees. In some embodiments, the slope comprises an angle of about 3 to 5 degrees. The aluminum electrolysis cell (1) includes an anode connector (20). The anode connector (20) is in electrical communication with the lower surface (34) of the bottom (30). In some embodiments, the bottom includes at least one slot configured to receive the anode connector. The anode connector (20) has an outer end (22) configured to connect to an external power source.

The aluminum electrolysis cell (1) includes at least one an elongate vertical anode (40) extending upward from the upper surface (32) of the bottom. The elongate vertical anode (40) has a proximal end (42), a distal free end (44) and a middle portion (46). The proximal end (42) of the elongate vertical anode is connected to the upper surface (32) of the bottom. The distal free end (44) of the elongate vertical anode extends upward toward the refractory top cover (17). In some embodiments, the elongate vertical anode (40) is aluminum-wettable. For example the elongate vertical anode (40) may comprise one or more of TiB2, ZrB2, HfB2, SrB2, carbonaceous material, W, Mo, and steel, and combinations thereof.

In some embodiments, the aluminum electrolysis cell (1) includes a cathode connector (50) proximal the refractory top cover (17). The cathode connector (50) has an upper connection rod (54) and a lower surface (52). The upper connection rod (54) is configured to connect to the external power source.

The aluminum electrolysis cell (1) includes at least one elongate vertical cathode (60). The elongate vertical cathode (60) extends downward from the lower surface (52) of the cathode connector (50). The elongate vertical cathode (60) has a proximal end (62), a distal free end (64), and a middle portion (66). The proximal end (62) of the elongate vertical cathode is connected to the upper surface (52) of the cathode connector (40). The distal free end (64) of the vertical cathode extends downward toward the base (7) of the aluminum electrolysis cell. In some embodiments, the elongate vertical cathode (60) is aluminum-wettable. For example the elongate vertical cathode (60) may comprise one or more of TiB2, ZrB2, HfB2, SrB2, carbonaceous material, and combinations thereof.

In the illustrated embodiment of FIGS. 1 and 2, the elongate vertical cathode (60) overlaps the elongate vertical anode (40) such that the distal end (64) of the elongate vertical cathode (60) is proximal the middle portion (46) of the elongate vertical anode (40). Furthermore, in the illustrated embodiment, the distal end (44) of the elongate vertical anode (40) is proximal the middle portion (66) of the elongate vertical cathode (60). In some embodiments, the anode-cathode overlap is configured to balance voltage requirements of the cell and/or energy consumption of the cell. In some embodiments, the anode-cathode overlap (ACO) is 0 to 50 inches. In some embodiments, the anode-cathode overlap (ACO) is 1 to 50 inches. In some embodiments, the anode-cathode overlap (ACO) is 5 to 50 inches. In some embodiments, the anode-cathode overlap (ACO) is 10 to 50 inches. In some embodiments, the anode-cathode overlap (ACO) is 20 to 50 inches. In some embodiments, the anode-cathode overlap (ACO) is 25 to 50 inches. In some embodiments, the anode-cathode overlap (ACO) is at least some overlap up to 12 inches of overlap. In some embodiments, the anode-cathode overlap (ACO) is at least 2 inches of overlap to 10 inches of overlap. In some embodiments, the anode-cathode overlap (ACO) is at least 3 inches of overlap to 8 inches of overlap. In some embodiments, the anode-cathode overlap (ACO) is at least 3 inches of overlap to 6 inches of overlap.

One or more inert spacers (100) may be located in between the elongate vertical cathode (60) from the elongate vertical anode (40) to maintain a desired anode to cathode distance (ACD). In some embodiments, the ACD may be ⅛ inch to 3 inches. In some embodiments, the ACD may be ⅛ inch to 2 inches. In some embodiments, the ACD may be ⅛ inch to 1 inch. In some embodiments, the ACD may be ⅛ inch to ¼ inch. In some embodiments, the ACD may be ¼ inch to ½ inch. In some embodiments, the ACD may be ⅛ inch to ¾ inch. In some embodiments, the ACD may be ⅛ inch to 1 inch. In some embodiments, the ACD may be ⅛ inch to ½ inch.

The refractory sidewalls (15), the refractory top cover (17), and the bottom (30) define a cell chamber (19) within the aluminum electrolysis cell (1). In some embodiments, the cell chamber (19) contains: a molten metal pad (250), a top layer of purified molten aluminum (400), and an electrolyte (300). The molten metal pad (250) is in contact with the bottom (30). The electrolyte (300) separates the top layer (400) from the molten metal pad (250). The elongate vertical anode (40) extends upward from the bottom (30), through the molten metal pad (250) and terminates in the electrolyte (300). The elongate vertical cathode (60) extends downward from the cathode connector (50) and terminates in the electrolyte (300) such that the elongate vertical cathode (60) overlaps the elongate vertical anode (40) within the electrolyte (300). Thus, the elongate vertical cathode (60) is separated from the elongate vertical anode (40) by electrolyte (300).

As described above, the electrolyte (300) separates the top layer of purified aluminum (400) from the molten metal pad (250). In this regard, the composition of the electrolyte (300) may be selected such that the electrolyte (300) has a lower density than the molten metal pad (250) and higher density than the top layer of purified aluminum (400). In some embodiments, the electrolyte (300) may comprise at least one of fluorides and/or chlorides of Na, K, Al, Ba, Ca, Ce, La, Cs, Rb, and combinations thereof, among others.

The molten metal pad (250) may comprise at least one alloy comprising one or more of Al, Si, Cu, Fe, Sb, Gd, Cd, Sn, Pb and impurities.

In some embodiments, the purified molten aluminum has 99.5 wt. % to 99.999 wt. % aluminum. In some embodiments, the purified molten aluminum has 99.6 wt. % to 99.999 wt. % aluminum. In some embodiments, the purified molten aluminum has 99.7 wt. % to 99.999 wt. % aluminum. In some embodiments, the purified molten aluminum has 99.8 wt. % to 99.999 wt. % aluminum. In some embodiments, the purified molten aluminum has 99.9 wt. % to 99.999 wt. % aluminum. In some embodiments, the purified molten aluminum has 99.95 wt. % to 99.999 wt. % aluminum. In some embodiments, the purified molten aluminum has 99.98 wt. % to 99.999 wt. % aluminum.

In some embodiments, the purified molten aluminum has 99.5 wt. % to 99.99 wt. % aluminum. In some embodiments, the purified molten aluminum has 99.5 wt. % to 99.95 wt. % aluminum. In some embodiments, the purified molten aluminum has 99.5 wt. % to 99.9 wt. % aluminum. In some embodiments, the purified molten aluminum has 99.5 wt. % to 99.8 wt. % aluminum. In some embodiments, the purified molten aluminum has 99.5 wt. % to 99.7 wt. % aluminum.

In some embodiments, the aluminum electrolysis cell (1) includes a plurality of elongate vertical anodes (40). In some embodiments, the aluminum electrolysis cell (1) includes a plurality of elongate vertical cathodes (60). The plurality of elongate vertical anodes (40) may be interleaved with the plurality of elongate vertical cathodes (60).

In some embodiments, the aluminum electrolysis cell (1) includes a cell access channel (70) penetrating the cell chamber (19) thereby providing access to the lower portion of the cell chamber. The cell access channel (70) may have an access port (72). Aluminum feedstock (200) may be added to the aluminum electrolysis cell (1) via the access port (72).

In some embodiments, the aluminum electrolysis cell (1) includes an aluminum extraction port (80) penetrating a refractory sidewall (15), thereby providing access to an upper portion of the cell chamber (19). Purified aluminum (400) may be extracted from the aluminum electrolysis cell (1) via the extraction port (80)

In some embodiments, the aluminum electrolysis cell (1) includes an inert gas inlet formed in the refractory top cover (17). The inert gas inlet is configured to provide an inert atmosphere (500) to the cell chamber (19).

In some embodiments, the aluminum electrolysis cell (1) includes an outer shell (5). The outer shell may comprise steel or other suitable materials. In some embodiments, the outer shell (5) may include a shell floor (6) located beneath the base. In some embodiments, the outer shell (5) may include shell sidewalls (9) spaced apart from and surrounding the refractory sidewalls (15).

In some embodiments, the aluminum electrolysis cell (1) may include thermal insulation (11). The thermal may be located between the shell floor (6) and the base (7) and between the shell sidewalls (9) and the refractory sidewalls (15). The thermal insulation may facilitate high electrical efficiency of the aluminum electrolysis cell (1).

One embodiment of a method for purifying aluminum includes supplying an electric current to the elongate vertical anode (40). Molten material, including molten aluminum, from the molten metal pad (250) may creep up the vertical surfaces of the elongate vertical anode (40). In some embodiments, the upward creep of the molten material from the molten metal pad may occur continuously during operation of the cell (1). In some embodiments, the elongate vertical anode may cover essentially all of the exposed surfaces of the elongate vertical anode (40). The molten aluminum on the surface of the elongate vertical anode (40) may be anodized via the elongate vertical anode (40), thereby producing aluminum ions. At least some of the aluminum ions may be transported through the electrolyte onto the surface of the elongate vertical cathode (60). At least some of the aluminum ions may be reduced via the elongate vertical cathode (60), thereby producing purified aluminum on the surface of the elongate vertical cathode (60). Without being bound by a particular mechanism or theory, one possible explanation is that the purified aluminum then creep up the surface of the elongate vertical cathode (60) due to the buoyancy of the purified aluminum in the electrolyte (300). Thus, the purified aluminum may tend to collect as a layer (400) above the electrolyte (300). For example, based on differences in density between the purified aluminum product and the electrolyte (e.g. bath components in the electrolyte), and the molten metal pad (e.g. including feedstock with aluminum metal, impurities, and/or densifying aids (additives to increase density such that the metal pad is configured with a density greater than the electrolyte such that the molten metal pad zone is configured below the electrolyte zone.

In some embodiments, the purified aluminum (400) may be produced via the electrolysis cell (1) at an energy efficiency of 1 to 15 kWh/kg of purified aluminum. In some embodiments, the purified aluminum (400) may be produced via the electrolysis cell (1) at an energy efficiency of 1 to 10 kWh/kg of purified aluminum. In some embodiments, the purified aluminum (400) may be produced via the electrolysis cell (1) at an energy efficiency of 1 to 8 kWh/kg of purified aluminum. In some embodiments, the purified aluminum (400) may be produced via the electrolysis cell (1) at an energy efficiency of 1 to 6 kWh/kg of purified aluminum. In some embodiments, the purified aluminum (400) may be produced via the electrolysis cell (1) at an energy efficiency of 1 to 4 kWh/kg of purified aluminum.

In some embodiments, the purified aluminum (400) may be produced via the electrolysis cell (1) at an energy efficiency of 5 to 15 kWh/kg of purified aluminum. In some embodiments, the purified aluminum (400) may be produced via the electrolysis cell (1) at an energy efficiency of 10 to 15 kWh/kg of purified aluminum. In some embodiments, the purified aluminum (400) may be produced via the electrolysis cell (1) at an energy efficiency of 12 to 15 kWh/kg of purified aluminum.

In some embodiments, the purified aluminum (400) may be produced via the electrolysis cell (1) at an energy efficiency of 2 to 10 kWh/kg of purified aluminum. In some embodiments, the purified aluminum (400) may be produced via the electrolysis cell (1) at an energy efficiency of 2 to 8 kWh/kg of purified aluminum. In some embodiments, the purified aluminum (400) may be produced via the electrolysis cell (1) at an energy efficiency of 2 to 6 kWh/kg of purified aluminum.

In some embodiments, the method may include adding aluminum feedstock (200) into the cell chamber (19) via the cell access port (72). In some embodiments, the aluminum feedstock (200) may be added essentially continuously during operation of the cell (1). In some embodiments, the aluminum feedstock (200) may be added by metering the aluminum feedstock (200) at a first feed rate. In some embodiments, the aluminum feedstock (200) may be added periodically.

In some embodiments, the method may include removing at least some of the top layer (400) of purified aluminum from the cell (1) via the aluminum extraction port (80). In some embodiments, the aluminum feedstock (200) may be removed essentially continuously during operation of the cell (1). In some embodiments, the first removal rate may be controlled, for example, based at least in part on the second removal rate. In some embodiments, the aluminum feedstock (200) may be removed periodically during operation of the cell (1). In some embodiments, the removing step is completed with equipment configured to remove the purified aluminum product without contaminating the product (e.g. alumina, graphite, and/or TiB2 tapping equipment).

In some embodiments, the method may include providing an inert atmosphere to the cell chamber (19) via the inert gas inlet (90). In this regard, the cell chamber may be sealed from the ambient atmosphere. Examples of inert gases include helium, argon, and nitrogen, among others.

In some embodiments, sludge (220) may be produced due, at least in part, to the passing step. The sludge (220) may have a higher density than the molten metal pad (250). As described above, the upper surface (32) of the bottom (30) may be sloped. In some embodiments, the slope may run from a refractory sidewall (15) down towards the cell access channel (70). Thus, the sludge (220) may drain along the upper surface (32) towards the cell access channel (70). In some embodiments, the sludge may be removed from the cell chamber (19) via the cell access channel (70). In some embodiments, impurities may tend to collect in the molten metal pad (250). Thus, the cell access channel (70) may facilitate removal of at least a portion of the molten metal pad (250).

EXAMPLES

The following examples are intended to illustrate the invention and should not be construed as limiting the invention in any way.

Bench Scale Electrolytic Purification Cell

Figure 3:
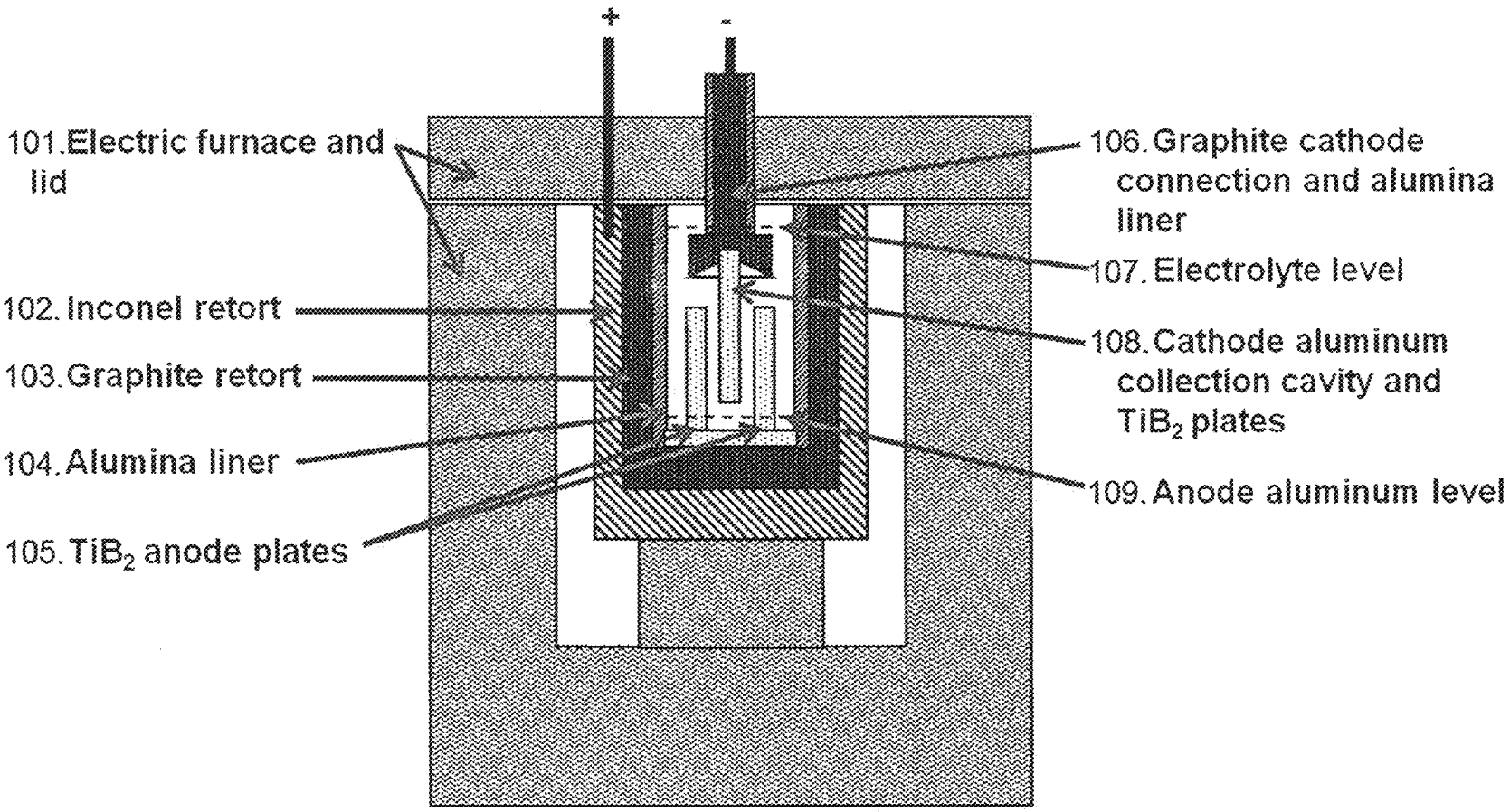
FIG. 3 is a side schematic (elevation view) of the electrolytic purification cell used for bench scale trials.
Figure 4:
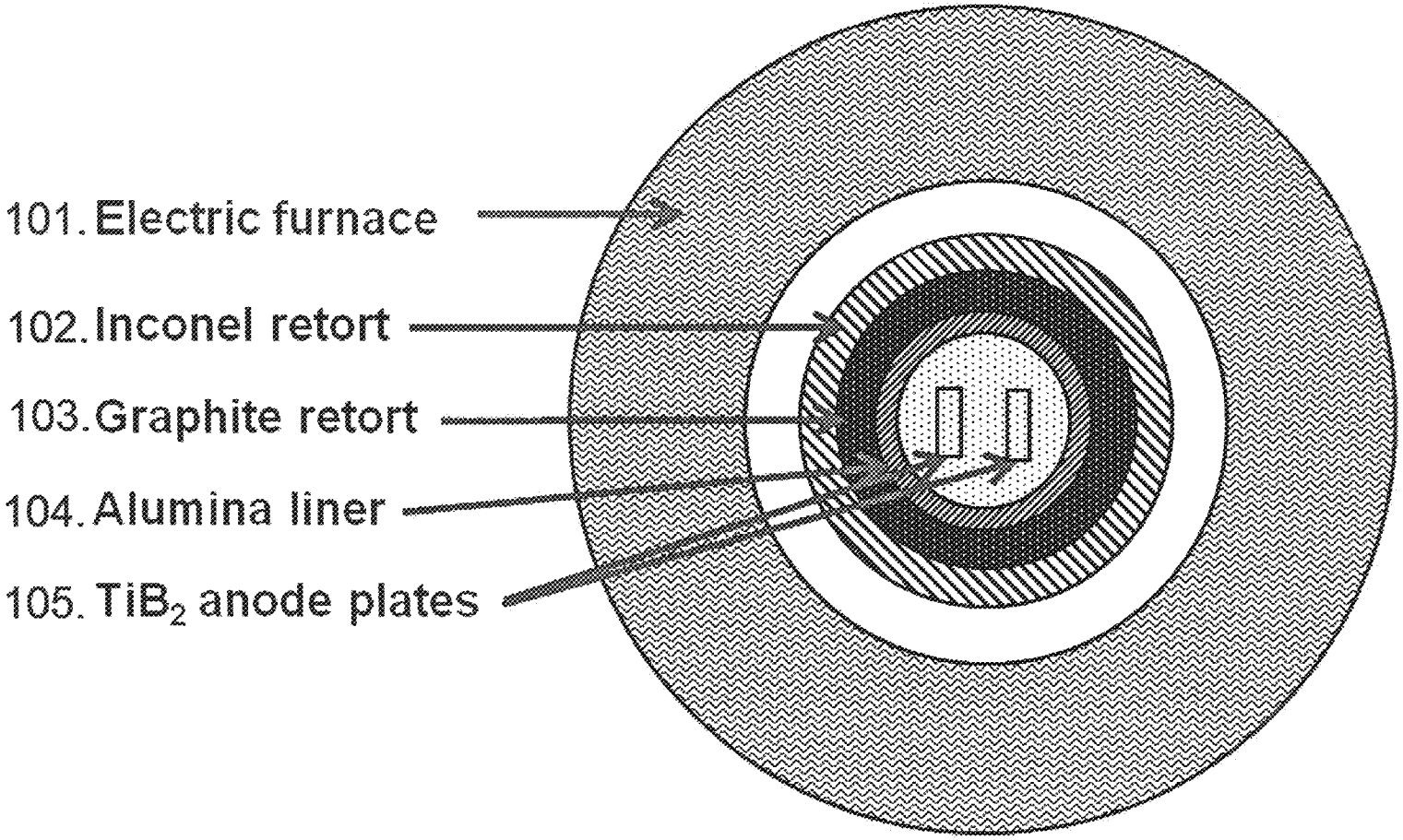
FIG. 4 is a top down schematic (plan view) of the electrolytic purification cell used for bench scale trials (the cathode assembly is not shown).
Figure 5:
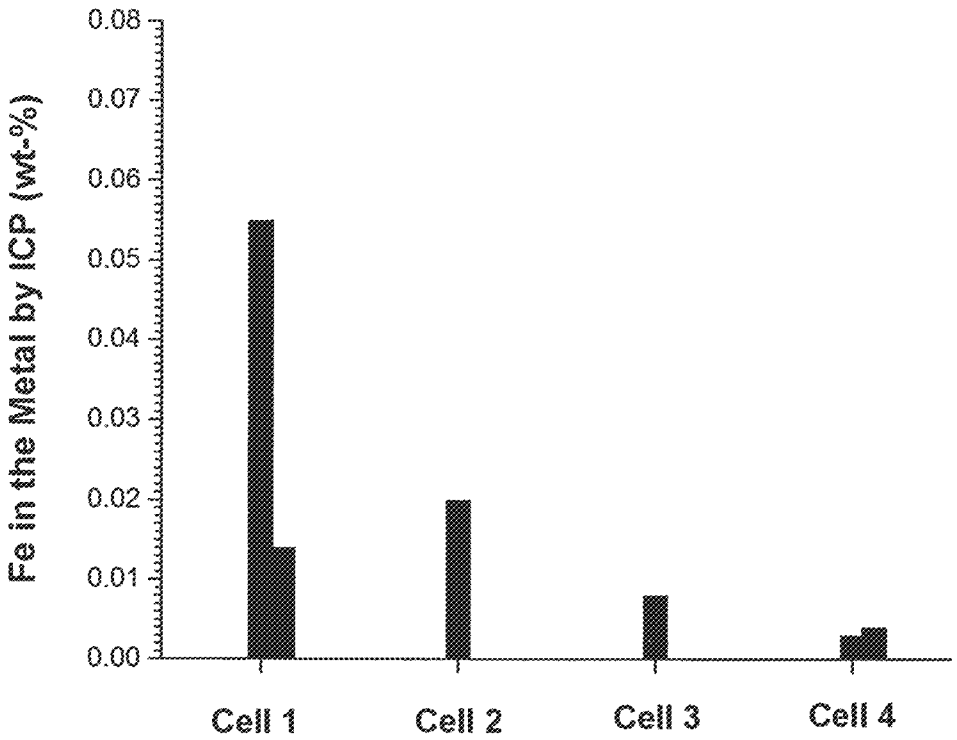
FIG. 5 is a graph depicting experimental data obtained, illustrated as Fe in the metal, as determined through ICP (wt. %) depicted for each cell.

A schematic of the cell used to conduct lab trials of the electrolytic purification cell is shown in FIGS. 3 and 4 (not to scale). FIG. 3 is a side schematic (elevation view) of the electrolytic purification cell used for bench scale trials. FIG. 4 is a top down schematic (plan view) of the electrolytic purification cell used for bench scale trials (the cathode assembly is not shown). FIG. 5 is a graph depicting experimental data obtained, illustrated as Fe in the metal, as determined through ICP (wt. %) depicted for each cell.

Four trial tests using different electrolytes and anode plate configurations were conducted using the cell configuration shown in the FIGS. 3 and 4. The cell was placed within an electric furnace (101) to heat and control cell temperature. Inside the furnace, the cell was contained in an Inconel retort (102) in which a graphite crucible (103) was placed. The graphite crucible provided the electrical connection to the anode aluminum pad at the bottom of the cell. An alumina liner (104) was placed within the graphite retort to provide electrical insulation between the graphite retort wall and the electrolyte, and the graphite retort wall and the cathode aluminum.

The impure aluminum (feed), alloyed with copper (e.g. as a densifying aid, at 15-60%, targeted at 35% by weight), was added to the cell as the anode aluminum. The copper was added to the impure aluminum to increase the melt density to be greater than the electrolyte. Two vertical anodes (TiB2 plates (105)) were installed in the anode aluminum pad with their ends extending vertically into the electrolyte.

The cathode electrical connection was constructed from a graphite block (106). A vertical cathode (TiB2 plate (108)) was pinned to the graphite cathode electrical connection and placed between the two anode plates. The cathode electrical connection was held by a superstructure not shown in FIG. 3. The cathode plate had the same dimensions as each anode plate for trial 1. For trial 2, the anode plate area was doubled while the cathode plate area was the same as for trial 1. The anode plate area was doubled by doubling its width where the width is the long dimension on the anode plate in the top down view of FIG. 4. Two other runs, trial 3 and 4, are depicted in Table 1, with the results of all four trials depicted in FIG. 5. The graphite block had a cavity to collect the pure aluminum as it was produced on the TiB2 plate and flowed upward due to buoyancy forces. The anode aluminum level (109) filled the bottom of the graphite crucible and decreased as the cell operated.

The electrolyte used in the trials was a mixture of AlF3, NaF, KF, and BaF2 salts. The electrolyte level (107) was maintained near the top of the graphite retort. The electrolyte mixture composition was chosen so that it had a density (when molten) between that of the anode aluminum and cathode aluminum. The electrolyte composition for trial 1 comprised BaF2, AlF3 and KF. The electrolyte composition for trial 2 comprised BaF2, AlF3 and NaF. Other useful electrolyte compositions include those having at least 5% BaF2 and at least 5% AlF3.

The cell containing the anode aluminum alloy and electrolyte mixture was heated and maintained at a temperature of 700 to 900 degrees C. by the electric furnace. A direct current of 0 to 150 amps was supplied between the anodes and cathode once the electrolyte mixture was at temperature.

Cell voltage, current and temperature were logged during each trial using a data acquisition system. Purified aluminum was collected in the cathode collection cavity. Iron impurity in the aluminum was measured to quantify purification performance from samples taken from the feed aluminum and purified molten aluminum. The elemental impurity concentrations from the molten aluminum were measured using inductively coupled plasma mass spectrometry (ICP).

The results from the two trials are shown in Table 1, below.

TABLE 1

Summary of results from the two electrolytic purification cell trials.

| | Cell Parameters | | | | | Metal Impurity by ICP | |
|---|---|---|---|---|---|---|---|
| Run # | Current (A) | Voltage (V) | Electrolyte Composition | Temperature C. | Duration (Hr) | Input Metal Fe (wt %) | Metal Tapped Fe (wt %) |
| Pure - 1 | 40 | 1.2 | AlF3—KF—BaF2 | 900 | 16 | 0.19 | 0.055 |
| | 60 | 1.5 | | 900 | 20 | | 0.014 |
| Pure - 2 | 40 | 0.6 | AlF3—NaF—BaF2 | 900 | 106 | 0.20 | 0.020 |
| Pure - 3 | 40 | 1.1 | AlF3—NaF—BaF2 | 850 | 53 | 1.4 | 0.008 |
| Pure - 4 | 50 | 1.2 | AlF3—NaF—BaF3 | 900 | 32 | 0.18 | 0.003 |
| | | | | | 42 | | 0.004 |

While a number of embodiments of the present invention have been described, it is understood that these embodiments are illustrative only, and not restrictive, and that many modifications may become apparent to those of ordinary skill in the art. Further still, the various steps may be carried out in any desired order (and any desired steps may be added and/or any desired steps may be eliminated).

What is claimed is:

1. An aluminum electrolysis cell comprising:

(a) a base;

(b) a bottom located proximal the base, wherein the bottom comprises an upper surface and a lower surface, wherein the upper surface of the bottom comprises a slope;

(c) an anode connector in electrical communication with the lower surface of the bottom, wherein the anode connector comprises an outer end configured to connect to an external power source;

(d) at least one an elongate vertical anode extending upward from the upper surface of the bottom;

(e) a cathode connector proximal a top cover, wherein the cathode connector has an upper connection rod and a lower surface, wherein the upper connection rod is configured to connect to the external power source;

(f) at least one elongate vertical cathode extending downward from the lower surface of the cathode connector, wherein at least some of the elongate vertical cathodes overlap with the elongate vertical anodes such that distal ends of the elongate vertical cathodes are proximal middle portions of corresponding elongate vertical anodes;

(g) a plurality of sidewalls located above the bottom;

(h) an aluminum metal extraction port penetrating at least one of the sidewalls, wherein the aluminum metal extraction port is located above distal ends of the plurality of elongate vertical anodes.

2. The aluminum electrolysis cell of claim 1, wherein the sidewalls, the top cover and the bottom define a cell chamber.

3. The aluminum electrolysis cell of claim 2, comprising a cell access channel penetrating the cell chamber, wherein the cell access channel comprises an access port.

4. The aluminum electrolysis cell of claim 2, comprising an inert gas inlet in the top cover, wherein the inert gas inlet is configured to provide an inert atmosphere to the cell chamber.

5. The aluminum electrolysis cell of claim 1, wherein the slope comprises an angle of less than 10 degrees.

6. The aluminum electrolysis cell of claim 5, wherein the slope comprises and angle of from 3 to 5 degrees.

* * * * *